US010231521B2

(12) United States Patent
Moroz

(10) Patent No.: US 10,231,521 B2
(45) Date of Patent: Mar. 19, 2019

(54) WORKSITE BAG

(71) Applicant: DIRTBAG DISTRIBUTORS INC., West Kelowna (CA)

(72) Inventor: Gary Kyle Moroz, West Kelowna (CA)

(73) Assignee: DIRTBAG DISTRIBUTORS INC., Kelowna (CA)

( * ) Notice: Subject to any disclaimer, the term of this patent is extended or adjusted under 35 U.S.C. 154(b) by 212 days.

(21) Appl. No.: 14/860,470

(22) Filed: Sep. 21, 2015

(65) Prior Publication Data

US 2016/0081448 A1 Mar. 24, 2016

Related U.S. Application Data

(60) Provisional application No. 62/052,572, filed on Sep. 19, 2014.

(51) Int. Cl.

| | |
|---|---|
| ***A45F 3/04*** | (2006.01) |
| ***A45C 13/02*** | (2006.01) |
| ***A45C 5/02*** | (2006.01) |
| ***A45C 3/12*** | (2006.01) |
| ***A45C 5/06*** | (2006.01) |

(52) U.S. Cl.

CPC ..... *A45C 13/02* (2013.01); *A45C 3/12* (2013.01); *A45C 5/02* (2013.01); *A45C 5/06* (2013.01)

(58) Field of Classification Search

CPC .. A45C 3/00; A45C 13/02; A45C 5/00; A45C 3/004; A45C 3/02

USPC ..... 190/111, 109, 100; 206/315.9, 457; 224/259, 257, 576, 644, 645, 651

See application file for complete search history.

(56) References Cited

U.S. PATENT DOCUMENTS

| | | | | |
|---|---|---|---|---|
| 4,805,749 | A | 2/1989 | Gerch | |
| 5,826,771 | A * | 10/1998 | Peng | A45F 3/04 224/651 |
| 5,950,895 | A * | 9/1999 | Zakarin | A45F 3/04 224/627 |
| 6,286,674 | B1 * | 9/2001 | Richard | A45C 7/0086 206/315.9 |
| 6,644,448 | B2 | 11/2003 | Bernbaum et al. | |
| 6,863,201 | B2 * | 3/2005 | Esqueda | A42B 3/006 224/576 |
| 7,971,764 | B2 * | 7/2011 | Sabbah | A45C 13/02 224/650 |
| 8,393,450 | B2 | 3/2013 | Lynch-Ringvold | |
| 8,800,737 | B2 * | 8/2014 | Fair | A45C 13/02 150/112 |
| 9,119,448 | B1 * | 9/2015 | Hirshberg | A45C 7/0077 |
| 9,629,442 | B2 * | 4/2017 | Ponx | A45F 3/04 |

(Continued)

*Primary Examiner* — Fenn C Mathew
*Assistant Examiner* — Cynthia Collado
(74) *Attorney, Agent, or Firm* — Richard D. Okimaw

(57) ABSTRACT

An apparatus for carrying articles to a worksite comprises an exterior barrier wall defining a bag having an interior cavity therein wherein, the bag extends between a front and rear surface and first and second sides and a plurality of divider walls dividing the interior of the bag into a plurality of compartments. The apparatus further includes first and second side compartments located to either side of the bag each shaped and size to correspond to and contain a work boot therein and an opening through the front exterior surface wall sized to pass a portion of a hard hat therethrough so as to retain a brim portion of the hard hat within the interior cavity.

11 Claims, 3 Drawing Sheets

(56) References Cited

U.S. PATENT DOCUMENTS

| | | | | |
|---|---|---|---|---|
| 2001/0017308 | A1* | 8/2001 | Le Gal | A45F 3/04 224/651 |
| 2002/0104768 | A1* | 8/2002 | Nevarez | A01K 97/06 206/315.11 |
| 2012/0024916 | A1* | 2/2012 | Horner | A42B 3/006 224/259 |
| 2013/0306696 | A1 | 11/2013 | Salas Garcia | |
| 2016/0278507 | A1* | 9/2016 | Ponx | A45F 3/04 |

* cited by examiner

WORKSITE BAG

BACKGROUND OF THE INVENTION

1. Field of Invention

The present invention relates generally to worksites and in particular to a an apparatus for carrying personal equipment to a worksite.

2. Description of Related Art

Many workers in the oil and gas industry travel from worksite to worksite, oftentimes in different locations across the country. Unfortunately, it can be difficult for them to transport and store the required equipment necessary for their line of work. Without any way to pack this equipment, workers typically toss the equipment in the back of a work truck, where it is subjected to inclement weather and increases the likelihood of becoming lost or misplaced.

Therefore, a device is needed that is capable of containing all the accessories required for working in the oil and gas industries. Applicant is aware of duffel bags capable of storing personal equipment for a worker. Such duffel bags, however frequently include a continuous side wall formed of a soft or deformable material. Disadvantageously, such duffel bags do not permit a person to see the contents therein without opening and inspecting the contents of the bag. Accordingly, for work sites which may require presentation of the necessary safety equipment, such duffel bags will require the removal therefrom prior to entry.

SUMMARY OF THE INVENTION

According to a first embodiment of the present invention there is disclosed an apparatus for carrying articles to a worksite comprising an exterior barrier wall defining a bag having an interior cavity therein wherein, the bag extends between a front and rear surface and first and second sides and a plurality of divider walls dividing the interior of the bag into a plurality of compartments. The apparatus further includes first and second side compartments located to either side of the bag each shaped and size to correspond to and contain a work boot therein and an opening through the front exterior surface wall sized to pass a portion of a hard hat therethrough so as to retain a brim portion of the hard hat within the interior cavity.

The exterior wall may be formed of a semi-rigid material. The exterior wall may be substantially waterproof. The exterior wall may be formed of a rubberized fabric.

The opening may comprise a circular bore through the exterior wall. The opening may have a diameter between 6 and 12 inches. The apparatus may further comprise a net panel extending over the opening.

The interior cavity may include a divider wall positioned to form a hard hat compartment wherein the opening passes through the exterior wall into the hard had compartment. The hard hat compartment may include an open top into the interior cavity of the bag for placing the hard hat thereinto.

The bag may include a selectably closable opening through a top thereof. The opening may be selectably close by a fastener. The fastener may be selected from the group consisting of hook and loop fasteners, hook and eyelets, zippers, snaps and magnets.

The first and second side compartments may include selectably closable side openings therethrough for locating a work boot therein. The side opening may be selectably close by a fastener. The fastener may be selected from the group consisting of hook and loop fasteners, hook and eyelets, zippers and magnets.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
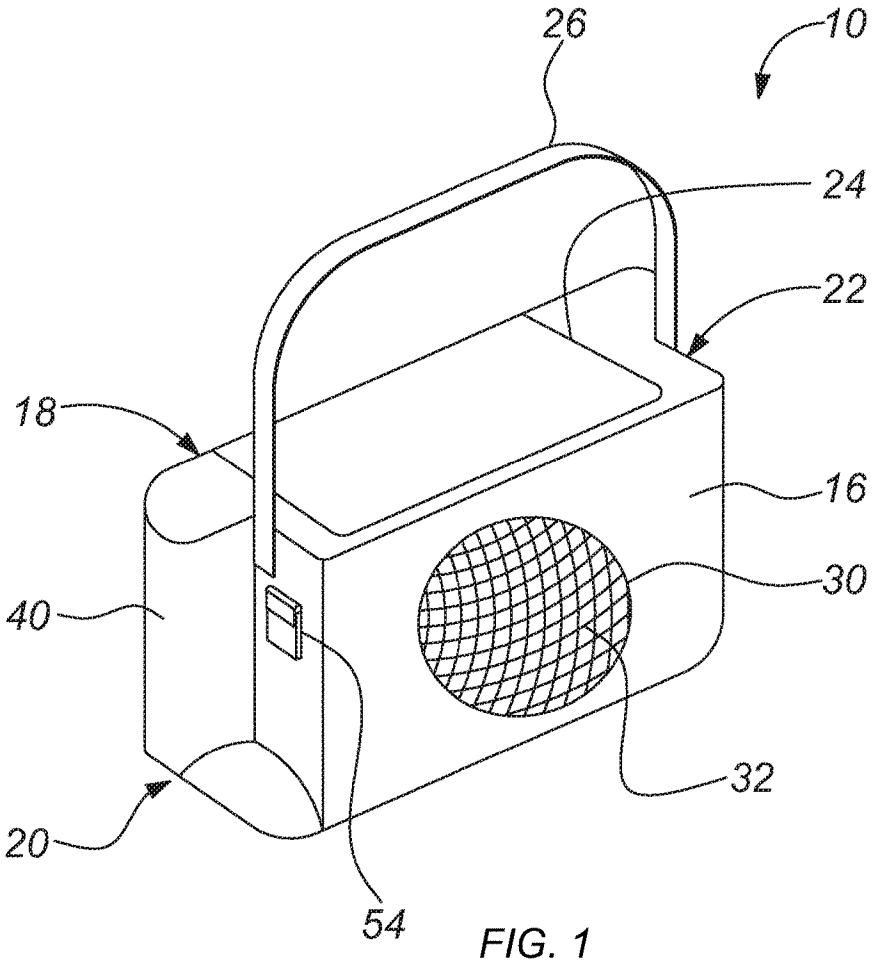
FIG. 1 is a perspective view of an apparatus for transporting equipment according to a first embodiment of the present invention.

Referring to FIG. 1, an apparatus for transporting personal articles of a worker according to a first embodiment of the invention is shown generally at 10. The apparatus comprises a bag 12 formed of an exterior wall 14. The bag 12 includes an opening 30 through a front portion thereof for locating a hard hat and first and second side pockets, 40 and 42, respectively, for locating work boots as will be more fully described below.

As illustrated in FIG. 1, the bag 12 extends between front and rear walls, 16 and 18, respectively and first and second sides, 20 and 22, respectively. The front wall 16 includes an opening 30 extending therethrough. The opening 30 is sized to permit the majority of a hard hat 8 to be passed therethrough while retaining a brim portion 7 therein to permit visual confirmation. Optionally, a mesh or other clear or see through panel 32 may be provided over the opening to assist in retaining the hard hat within the bat 12. The opening 30 may have a substantially circular shape as illustrated, however it will be appreciated that any other shape may be useful as well, such as by way of non-limiting example, square, triangular, oval, rectangular or irregular. The opening 30 has a diameter chosen to retain the hard hat within the interior of the bag while retaining the brim portion 7 therein. By way of non-limiting example, the opening 30 may have a diameter of between 6 and 12 inches (152 and 305 mm) although it will be appreciated that other diameters may be useful as well.

As illustrated in FIG. 1, the bag 12 may also include an opening 24 to permit access into the interior of the bag. As illustrated in FIG. 1, the opening may comprise a flap over the top of the bag which may be closed by one or more fasteners, such as by way of non-limiting example, hook and loop fasteners, zippers, hook and eyelets, snaps, magnets or any other conventionally known fastener. Optionally, the bag 12 may include one or more handles or straps 26 for carrying the bag 12 as are commonly known.

Figure 2:
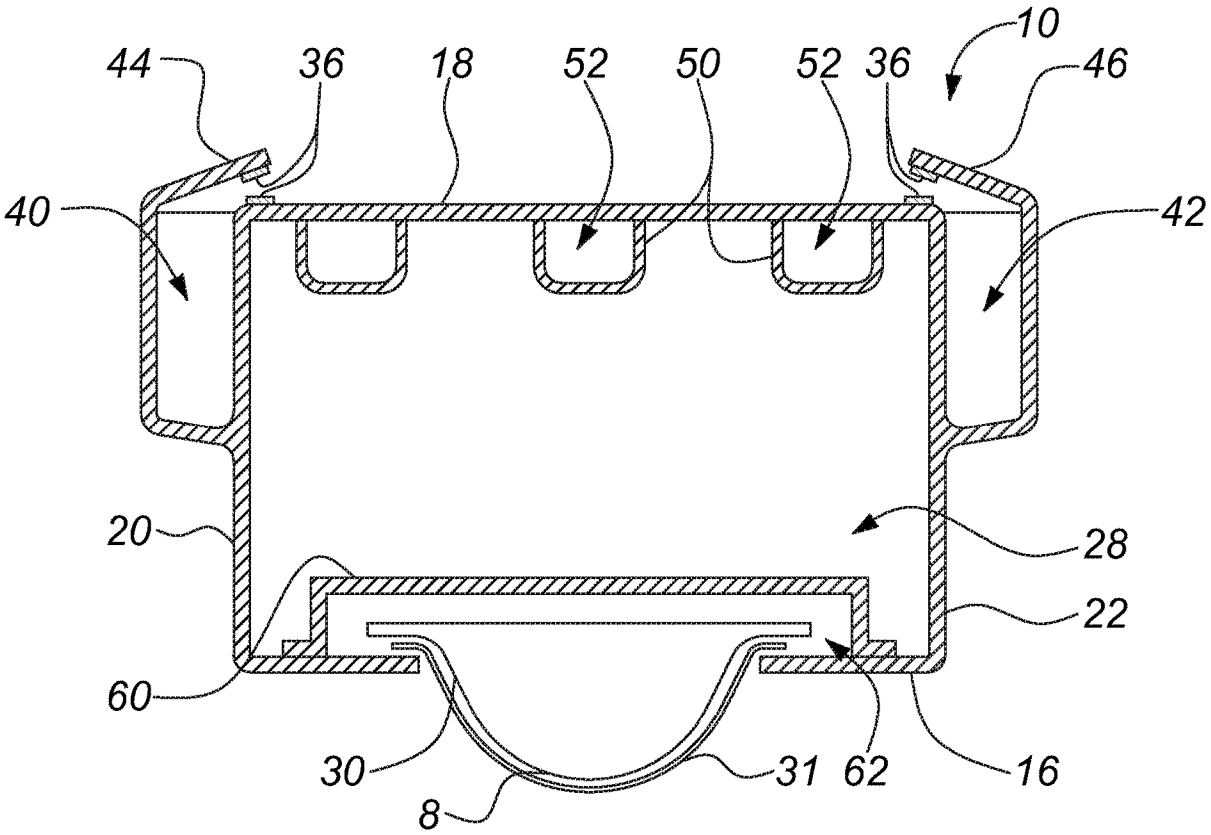
FIG. 2 is a cross sectional view of the apparatus of FIG. 1 as taken along the line 2-2.

The first and second side pockets 40 and 42 are sized and shaped to correspond to the shape of a work boot so as to permit a boot to be located in each. As illustrated in FIG. 2, each of the first and second side pockets 40 and 42 may have a flap, 44 and 46, respectively, to permit access thereto. The flap may be closed by one or more fasteners, such as by way of non-limiting example, hook and loop fasteners, zippers, hook and eyelets, snaps, magnets or any other conventionally known fastener. The bag 12 may also optionally include one or more exterior pockets 54 as illustrated in FIG. 1 as are commonly known.

Figure 3:
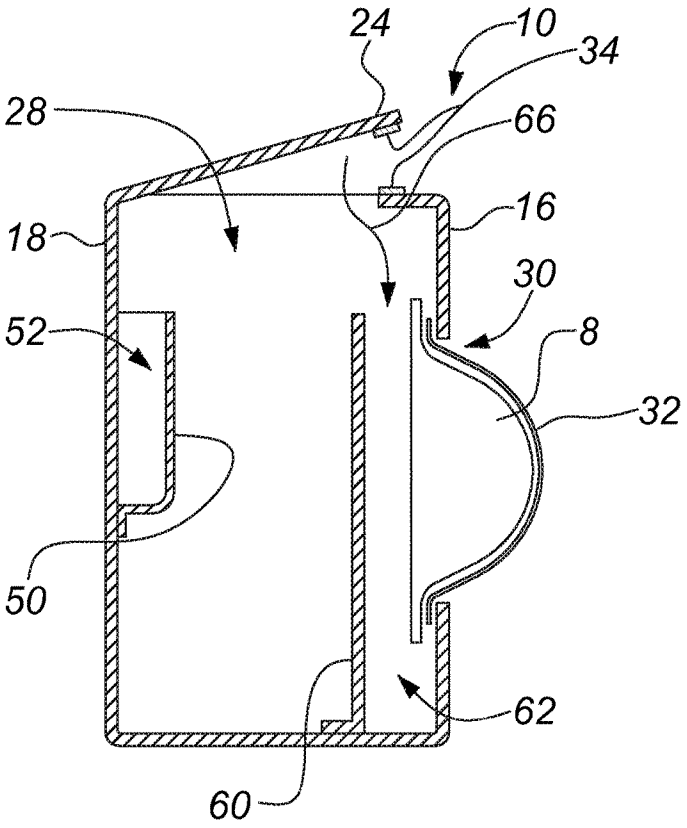
FIG. 3 is a cross sectional view of the apparatus of FIG. 1 as taken along the line 3-3.

Turning now to FIGS. 2 and 3, the bag 12 may include a plurality of dividers located within an interior cavity 28 of the bag to divide or otherwise separate the interior cavity into a plurality of pockets and compartments. In particular, pocket walls 50 may extend from the exterior wall 14 to form a pocket thereagainst.

In addition, the interior cavity 28 may include a hard hat wall 60 extending from the exterior wall 14 of the bag 12 and extending around the opening 30. In particular as illustrated in FIG. 2, the hard hat wall 60 may extend from and be connected to the front wall 16 of the bag interior to form the hard hat compartment 62 around the opening. The hard hat compartment 62 is sized to receive a hard hat 8 therein as set out above. As illustrated in FIG. 3, the hard hat wall 60 extends to a top edge 64 which is spaced below the top of the bag to permit a hard hat to be slidably located within the hard hat compartment 62 in a direction generally indicated at 66.

The bag 12 may be formed of any suitable material to be flexible and strong enough to contain the equipment therein. Optionally, the bag 12 may be formed of a waterproof material. In particular, and by way the bag may be formed of a plastic, canvas or rubberized fabric. The bag 12 may be formed by any conventional means such as by way of non-limiting example, sewing, injection moulding, adhesives, welding or the like.

While specific embodiments of the invention have been described and illustrated, such embodiments should be considered illustrative of the invention only and not as limiting the invention as construed in accordance with the accompanying claims.

What is claimed is:

1. An apparatus for carrying articles to a worksite comprising:

an exterior barrier wall defining a bag having an interior cavity therein and a top opening along a top thereof having a top fastener for selectively closing said top opening, said interior cavity extending between a front and rear surfaces and first and second sides of said bag;

a plurality of divider walls dividing said interior cavity of said bag into a plurality of compartments, at least one of said plurality of divider walls being non-continuous to said top of said bag and extending to a free top edge, said free top edge proximate to and spaced below said top opening;

first and second side compartments located to either side of said bag each shaped and sized to correspond to and contain a work boot therein;

a front opening through said front surface of said exterior barrier wall sized to pass a central portion of a hard hat therethrough so as to retain a brim portion of said hard hat within said interior cavity;

wherein said top opening is sized to pass said hard hat therethrough and over said free top edge of said at least one of said plurality of divider walls into a front compartment proximate to said front opening; and wherein one of said at least one of said plurality of divider walls is positioned to bias said hard hat such that said central portion of said hard hat passes through said front opening.

2. The apparatus of claim 1 wherein said exterior barrier wall is formed of a semi-rigid material.

3. The apparatus of claim 1 wherein said exterior barrier wall is substantially waterproof.

4. The apparatus of claim 1 wherein said exterior barrier wall is formed of a rubberized fabric.

5. The apparatus of claim 1 wherein said front opening comprises a circular bore through said front surface of said exterior barrier wall.

6. The apparatus of claim 5 wherein said front opening has a diameter between 6 and 12 inches.

7. The apparatus of claim 6 further comprising a net panel extending over said front opening.

8. The apparatus of claim 1 wherein said top fastener is selected from the group consisting of hook and loop fasteners, hook and eyelets, zippers, snaps and magnets.

9. The apparatus of claim 1 wherein said first and second side compartments include selectably closable side openings therethrough for locating a work boot therein.

10. The apparatus of claim 9 wherein said side opening is selectably closeable by a side fastener.

11. The apparatus of claim 10 wherein said side fastener is selected from the group consisting of hook and loop fasteners, hook and eyelets, zippers and magnets.

* * * * *